US007439430B1

(12) United States Patent
Chang

(10) Patent No.: US 7,439,430 B1
(45) Date of Patent: Oct. 21, 2008

(54) SAXOPHONE D# (D SHARP) KEY CLAMP

(76) Inventor: Shun-Hwa Chang, P.O. Box 3387, Fremont, CA (US) 94539

( * ) Notice: Subject to any disclaimer, the term of this patent is extended or adjusted under 35 U.S.C. 154(b) by 0 days.

(21) Appl. No.: 11/685,123

(22) Filed: Mar. 12, 2007

Related U.S. Application Data

(63) Continuation-in-part of application No. 11/425,632, filed on Jun. 21, 2006.

(51) Int. Cl.
*G10D 7/00* (2006.01)
*G10D 9/00* (2006.01)

(52) U.S. Cl. ..... 84/385 R; 84/390 R; 84/385 A; 84/385 P

(58) Field of Classification Search ..... 84/385 R, 84/385 A, 385 P, 380 R; D17/10, 13, 99
See application file for complete search history.

(56) References Cited

U.S. PATENT DOCUMENTS 1,610,207 A * 12/1926 Hilton ..... 84/385 R
1,662,195 A * 3/1928 Loomis ..... 84/385 R
1,691,515 A * 11/1928 Gesford ..... 84/385 R
1,777,902 A * 10/1930 Stover ..... 84/385 R
2,471,290 A * 5/1949 Sommaruga ..... 84/385 R
2,522,424 A * 9/1950 Arnold ..... 84/385 R
3,691,893 A * 9/1972 Dickson, Jr. ..... 84/453
4,763,882 A * 8/1988 Nishiyama et al. ..... 267/33
5,898,116 A * 4/1999 Lin ..... 84/380 R
6,143,969 A * 11/2000 Lin ..... 84/385 R
2003/0221539 A1 * 12/2003 Chang ..... 84/385 A

* cited by examiner

*Primary Examiner*—Jeffrey Donels
*Assistant Examiner*—Christopher Uhlir
(74) *Attorney, Agent, or Firm*—Roger H. Chu

(57) ABSTRACT

A device for keeping the D# (D Sharp) tone hole open hence corresponding pad cup of a saxophone drier is described. According to one exemplary embodiment of the present invention, the device is a key clamp for holding down the D# key such that the D# pad cup can be kept open when the saxophone is not being played. The device is made of a continuous wire having a first segment having a first end, and a second segment having a second end, said first segment and said second segment are oriented substantially perpendicular to each other but non-coplanar, wherein said first segment has a form of an unsymmetrical S-shape, and said second segment has a form of a substantially closed loop.

14 Claims, 6 Drawing Sheets

SAXOPHONE D# (D SHARP) KEY CLAMP

CROSS REFERENCE TO RELATED APPLICATION

This application is a continuation-in-part of a U.S. patent application Ser. No. 11/425,632 filed Jun. 21, 2006, the entire contents of which are incorporated herein by reference.

RELATED FIELD OF THE INVENTION

The present invention generally relates to the area of woodwind music instrument accessories, and more particularly to a device for clamping down the D# (D Sharp) key of a saxophone.

BACKGROUND OF THE INVENTION

Saxophone is a conical-bored woodwind music instrument, usually made of brass and played with a single-reed mouthpiece. As shown in FIG. 1A, the saxophone's bore is effectively conical with a number of curves, the first at the neck, one about three quarters down the cone, called the bow, and one slight curve near the bell, which points more or less directly forward and upward from the player at about waist level. The saxophone produces different notes using a key system comprising of keys, pads, pad cups and tone holes. When pressure is applied to a key, it opens or closes one or more of the tone holes by lifting or lowering a pad that is contained in a pad cup. The pad cup is connected to the key via a mechanism including a rock shaft supported by a pair of studs with a bar or arm connecting the key and the pad cup. The pad fit inside a pad cup, usually made of leather or leather-like materials, covers a corresponding tone hole and form an airtight seal. Depending on the locations of the pad and corresponding tone hole on the saxophone, the pitch can be raised or lowered. When a saxophone is not being played, some of the pad cups are in an open position, some are in a closed position. This configuration is referred to as a normal position of the pad cup in this paper. For example, the normal position of the pad cup for tone hole D# (D Sharp) is closed.

When a player plays a saxophone, some of the breaths are condensed inside the saxophone. As a result, moistures (e.g., saliva of the player) are accumulated in and around the lip of the tone holes after each usage. For those tone holes with normal position closed (e.g., D# tone hole), the accumulated moistures are trapped between the lip of the tone holes and the pad covered the lip. The accumulated moistures need to be dried out quickly. Otherwise the residue of the moistures would cause damages, which result into very costly repairs. For example, the contact area (i.e., a circular grove 134 as shown in FIGS. 1C and 1D) between the pad and the lip of the tone hole may become sticky. As a result, the pad needs to be replaced. More serious damage may be caused by corrosion of the tone hole lip due to acid contents of the accumulated moistures. The notes cannot be produced properly. For the D# tone hole, there is even higher probability to accumulate moistures due to its location near the bow of the saxophone.

Therefore, it would be desirable to have a device that can keep the D# tone hole open, when a saxophone is not being played such that the D# tone hole and pad can have better chance to dry out.

SUMMARY OF THE INVENTION

This section is for the purpose of summarizing some aspects of the present invention and to briefly introduce some preferred embodiments. Simplifications or omissions in this section as well as in the abstract and the title herein may be made to avoid obscuring the purpose of the section. Such simplifications or omissions are not intended to limit the scope of the present invention.

A device for keeping the D# (D sharp) tone hole open and corresponding pad cup of a saxophone drier is disclosed. Since the normal position of the D# pad cup is closed, there is less opportunities for the D# tone hole and the pad to dry after being played. One remedy is to increase air flows through the D# tone holes and the pad, while a saxophone is not being played. According to one exemplary embodiment of the present invention, the device is a key clamp for holding down the D# key such that the D# pad cup can be kept open when the saxophone is not being played. The key clamp is made of a continuous slightly flexible wire that is covered with sturdy soft coating (e.g., plastic or alike). The continuous wire is made of a material soft enough that can be reshaped by a player's hands, but strong enough that can maintain a pressure to hold down the D# key hence to keep the D# pad cup open. The main function of the coating is to prevent scratches to the saxophone when the key clamp is deployed. In other word, not only the material of the coatings needs to be softer than that of the saxophone, but also needs to be sturdy enough to endure the wear and tear of repetitive usages so that the wire inside will not be exposed.

The continuous wire, having a first end and a second end, includes two parts: a first segment and a second segment. The first segment and the second segment are oriented substantially perpendicular to each other but non-coplanar at a point between the first end and the second end. The first segment has a form of an unsymmetrical S-shape that has a larger opening near the first end and a smaller opening near the second segment of the wire. The larger opening of the S-shape is configured to adjustably form an arc so that the arc can be fitted in and around the tubular body of a saxophone. The function of the arc is to stabilize the key clamp so that the second segment can be fitted into a space between the top the D# key and the lip of a tone hole located nearby. The second segment has a form of a substantially closed loop, which is formed by bending the second end back towards the second segment of the wire. The shape of the closed loop may include, but not necessarily be, triangular, quadrilateral, polygonal, and round (e.g., circular, oval, etc.). The function of the closed loop is to reinforce the second segment such that a pressure larger than the resistance of the spring of the D# key can be maintained when the key clamp is deployed onto a saxophone.

One of the objects, features, and advantages of the present invention is to avoid costly repair of the D# pad of a saxophone by providing an environment that the D# pad can be dried out faster.

Other objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will be better understood with regard to the following description, appended claims, and accompanying drawings as follows:

DETAILED DESCRIPTION

In the following description, numerous specific details are set forth in order to provide a thorough understanding of the present invention. However, it will become obvious to those skilled in the art that the present invention may be practiced without these specific details. The descriptions and representations herein are the common means used by those experienced or skilled in the art to most effectively convey the substance of their work to others skilled in the art.

Reference herein to "one embodiment" or an "embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments.

Embodiments of the present invention are discussed herein with reference to FIGS. 1A-4D. However, those skilled in the art will readily understand and appreciate that the detailed descriptions given herein with respect to these figures is for explanatory purposes as the invention extends beyond these limited embodiments.

Figure 1A:
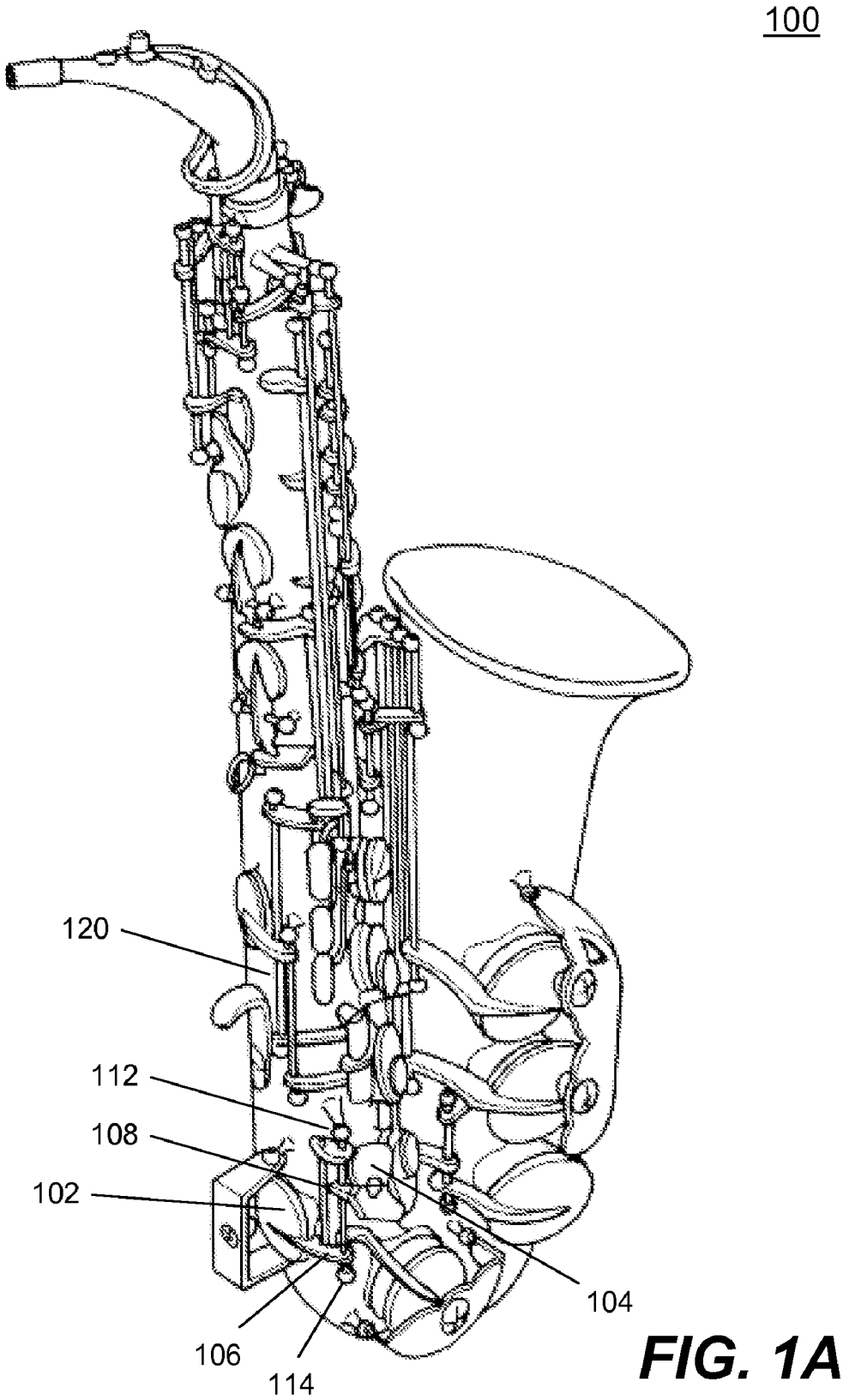
FIG. 1A is a simplified diagram depicting a perspective view of an exemplary saxophone, on which an embodiment of the present invention is deployed.

Referring now to the drawings, in which like numerals refer to like parts throughout the several views. FIG. 1A shows an exemplary saxophone 100. The saxophone 100 has a main tubular body 120 with a number of tone holes. Each of the tone holes has a pad cup that can be open or closed via a key with pressure from the finger of a player. The normal position of the D# pad cup 102 is in a closed configuration, when the corresponding D# key 104 of the saxophone 100 is not pressed down (i.e., at rest not being played). In order to keep the D# pad cup 102 open, a pressure larger than the resistance of the spring (not shown in FIG. 1A) must be applied constantly on the D# key 104. According to one aspect of the present invention, a device is deployed in and around the D# key 104 and the tubular body 120 of the saxophone 100 that can keep the D# pad cup 102 open when the saxophone 100 is not being played.

Figure 1B:
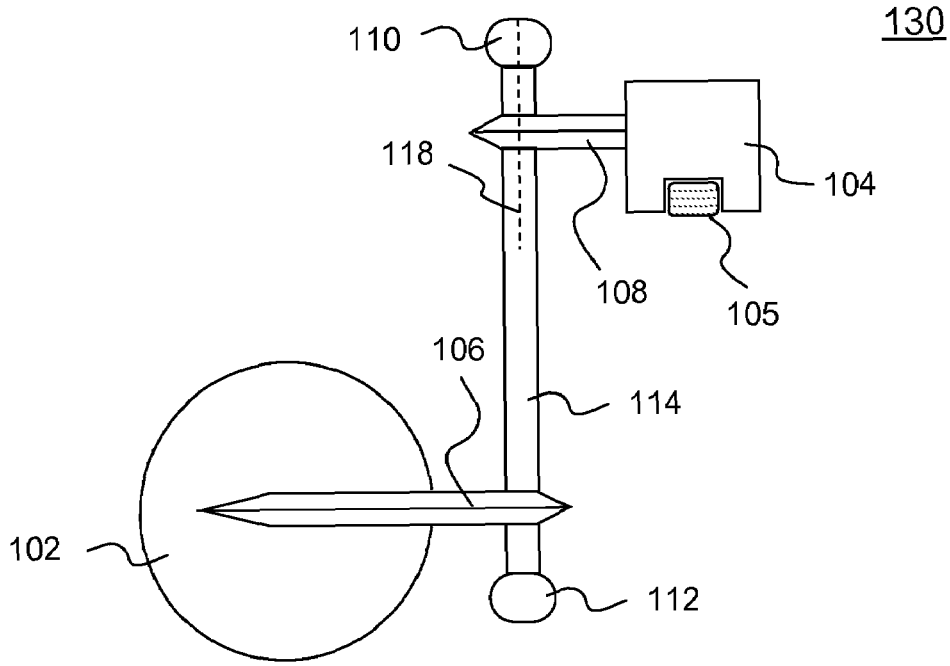
FIG. 1B is a more or less diagrammatic view showing an exemplary mechanism controlling the D# (D sharp) pad cup of the saxophone of FIG. 1A.

FIG. 1B is a diagram 130 illustrating a control mechanism for D# key 104 and D# pad cup 102. Although the diagram 130 shows the mechanism in a two-dimensional view, actual orientation between the D# key 104 and the D# pad cup 102 is at an angle to each other in the out-of-plane direction (e.g., look down from top of rock shaft 114). In other words, the D# key 104 is located at a first side of the tubular body 120 and the D# pad cup 102 is located at a second side of the tubular body 120. The first side and the second side are not oriented in the same plane. In one embodiment, the first side and the second side are oriented at an angle substantially equal to 90 deg. The control mechanism includes a rock shaft 114 supported by two studs 110 and 112. The rock shaft 114 can be rotated about an axis through the center of the studs 110 and 112. The D# key 104 connects to a rock shaft 114 via a connecting bar or arm 108. The connecting bar 108 is fixedly connected to the bottom of the D# key 104 at one end and fixedly connected to the rock shaft 114 at the other end. The D# pad cup 102 connects to the rock shaft 114 via a connecting bar 106. The connecting bar 106 is fixedly connected to the top of the D# pad cup 102 at a first end, and fixedly connected to the rock shaft 114 at a second end. As a result of the mechanism, the D# key 104, the connecting bar 108, the connecting bar 106 and the D# key cup are moved in unison. When the player presses down the D# key 104, the rock shaft 114 will be rotated about the axis 110-112 accordingly, so will the connecting arm 106 and the D# key cup 102. As a result, the D# key cup 102 will be at an open configuration. In other words, the D# key 104 moves down (i.e., into the plane of the paper) and the D# key cup moves up (i.e., out of the plane of the paper). In addition, a dotted line 118 represents a spring located right under the connecting bar 108. The spring 118 is configured to hold the connecting arm 108 and the D# key 104 in the normal position, which corresponds to the closed configuration of the D# key cup and tone hole. In order to open the D# key cup, the force or pressure from the player finger must be larger the resisting force of the spring 118. According to one embodiment, a device is designed to keep the D# key 104 pressed down, when the saxophone is not being played. The D# key 104 includes a roller 105, which moves in unison.

Figure 1C:
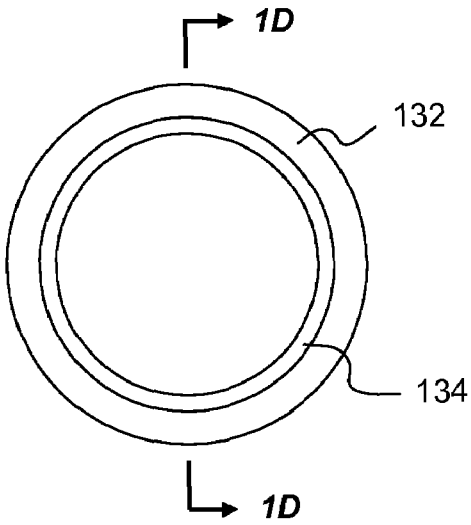
FIGS. 1C and 1D are diagrams showing the contact area between the pad and the lip of the D# tone hole of the saxophone of FIG. 1 in a normal position.
Figure 1D:
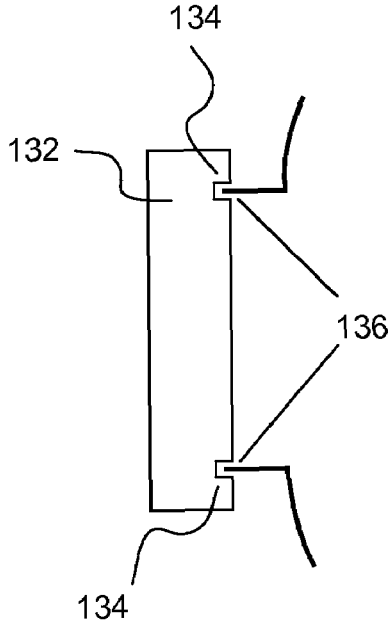

FIGS. 1C and 1D show the contact area between the pad 132 and the lip 136 of the D# tone hole in a normal position. The inside of the pad 132 is made of layers of soft material (e.g., foam) and a relative hard paper card board in form of circular discs. The outside skin of the pad 132 is made of soft leather or leather like materials. When the pad 132 is originally made, it has a flat circular surface. A circular grove 134 is formed by pressing down the pad 132 onto the lip 136 of the D# tone hole. The spring 118 keeps a constant pressure between the pad 132 and the lip 136. The grove 134 is the area that collects the accumulated moistures from each play of the saxophone. According to one aspect of the present invention, a device is to deploy on a saxophone such that the D# pad cup 132 is kept open when the saxophone is not being played.

Figure 2A:
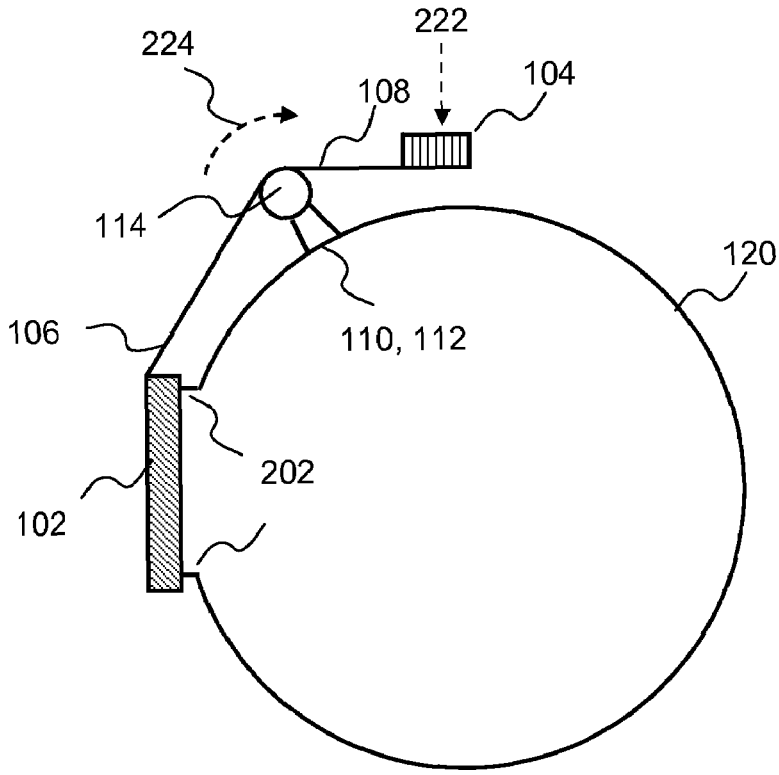
FIG. 2A is a diagram showing the orientation between the D# key and the D# pad cup of the saxophone of FIG. 1A in a closed configuration.
Figure 2B:
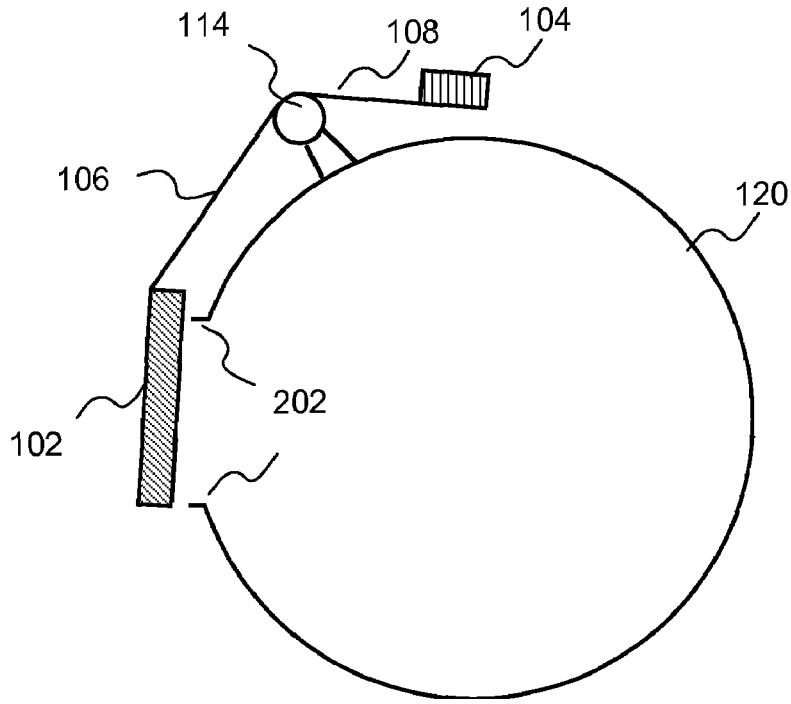
FIG. 2B is a diagram showing the orientation between the D# key and the D# pad cup of the saxophone of FIG. 1A after the D# key is pressed down.

FIG. 2A shows a plan view of a normal position of the D# key 104 and D# pad cup 102 of the saxophone of FIG. 1A. The plan view is a cross-section cut of the tubular body 120 at the D# tone hole. Lip 202 of the D# tone hole is in contact with the D# pad cup 102 forming an airtight seal. Top of the D# pad cup 102 is fixed connected to one end of the connecting arm 106. The other end of the connecting arm 106 is fixedly connected to the rotary shaft 114 that is supported by two studs 110 and 112. Bottom of the D# key 104 is fixedly connected to one end of the connecting arm 108, which is fixedly connected to the rotary shaft 114 at the other end. When a pressure 222 is applied to the top of the D# key 104, the rotary shaft 114 will be rotated in a direction 224 as indicated. The pressure 222 may be a result from holding down the D# key 104 from the player's finger during playing of the saxophone, or from a device, according to an embodiment of the present invention. The pressure 222 must be larger than the resistance of the spring 118 (not shown in FIG. 2A) holding the connecting arm 108 of the D# key 104. As a result of rotation motion of the control mechanism (i.e., D# key 104, connecting arm 108, connecting arm 106 and D# pad cup 102) in the direction 224, the D# pad cup 102 will be lifted from the lip 202 of the D# tone hole to a configuration as shown in FIG. 2B. According to one embodiment of the present invention, a device (e.g., a key clamp) is deployed to keep the control mechanism in the configuration as shown in FIG. 2B.

Figure 3:
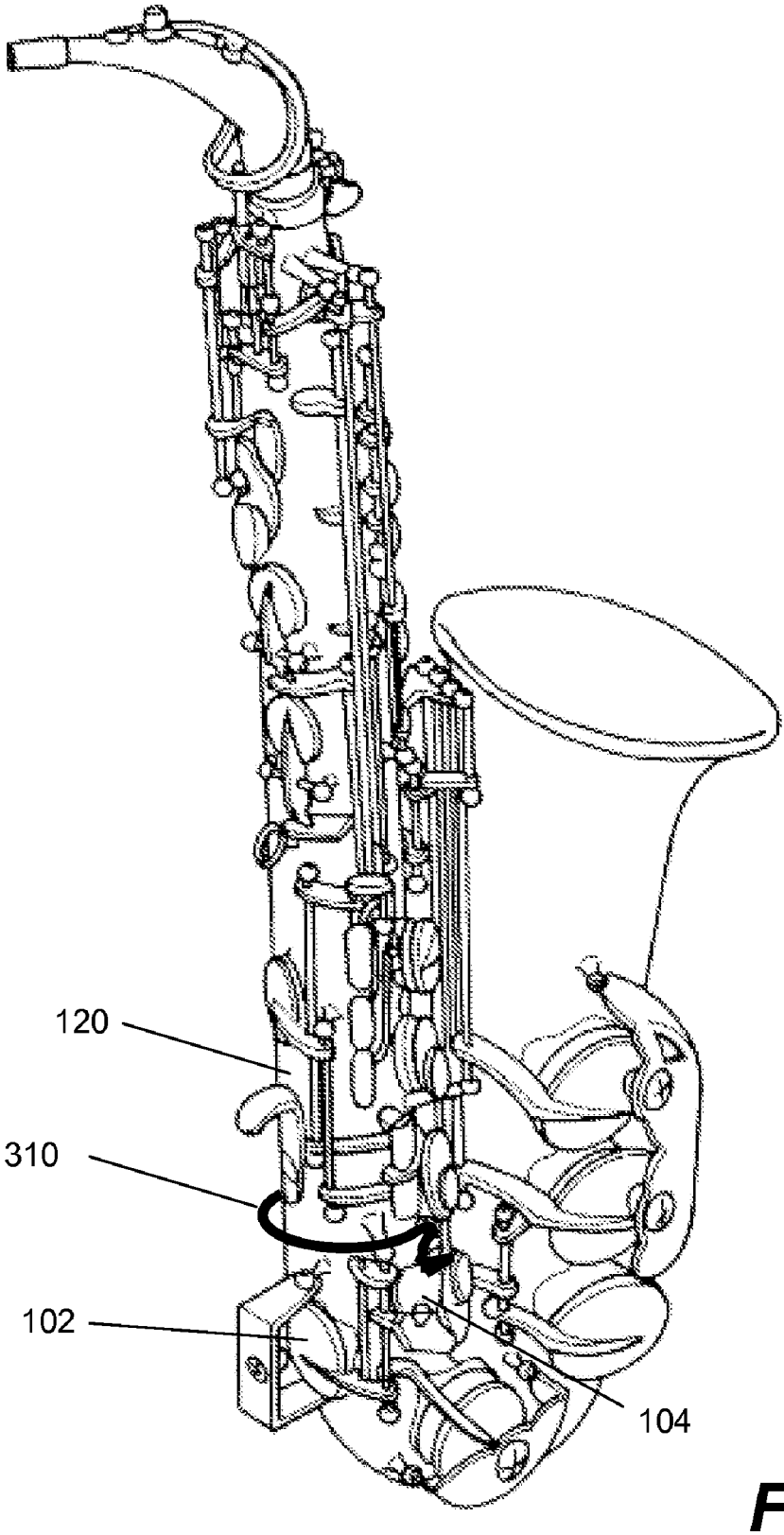
FIG. 3 is a simplified diagram illustrating an exemplary key clamp, according to an embodiment of the present invention, deployed on the saxophone of FIG. 1A.
Figure 4A:
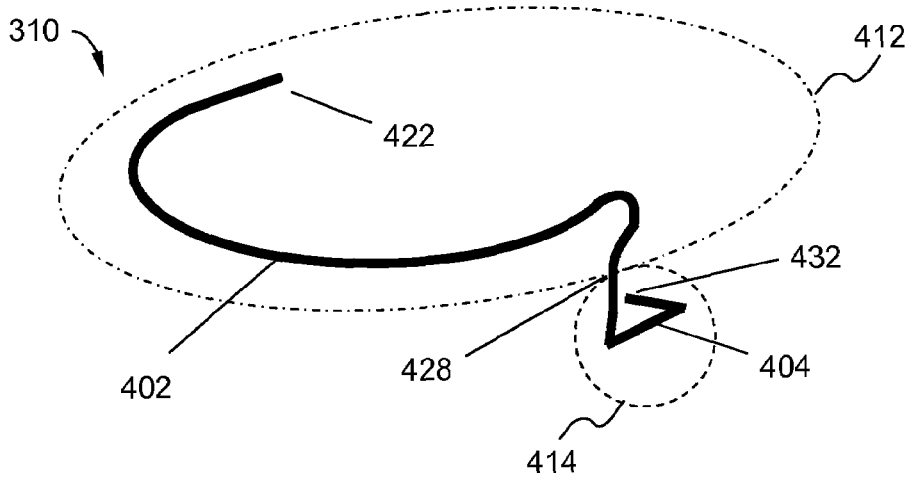
FIG. 4A is a perspective view showing an exemplary key clamp in accordance with one embodiment of the present invention.
Figure 4B:
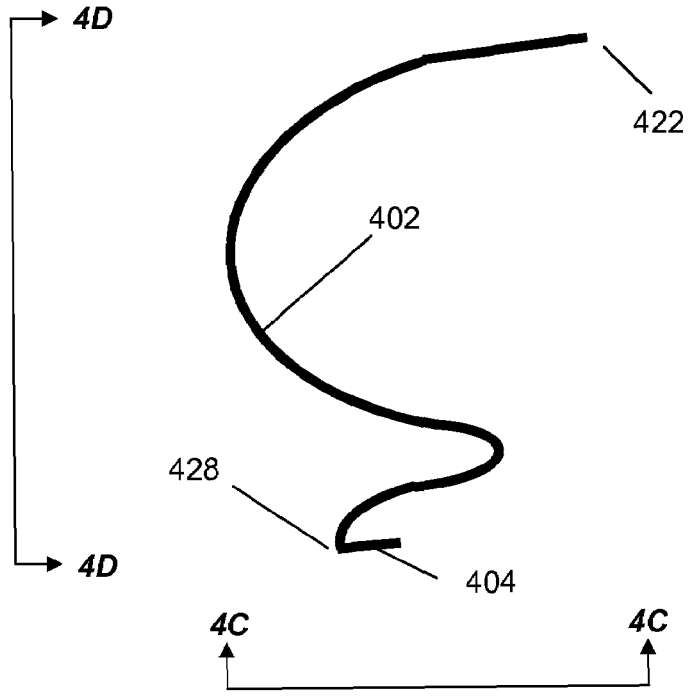
FIGS. 4B-4D are top plan view, and two side elevation views of the exemplary key clamp FIG. 4A, respectively.
Figure 4C:
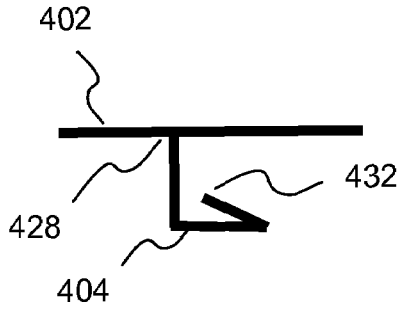
Figure 4D:
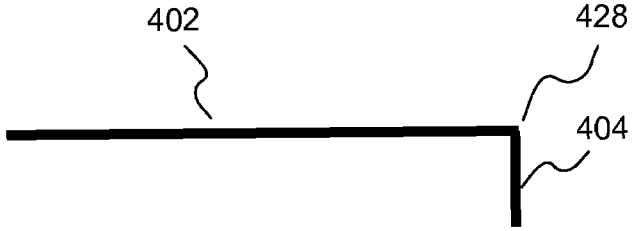

FIG. 3 shows an exemplary device (i.e., key clamp 310) is deployed on the saxophone of FIG. 1A in accordance with one embodiment of the present invention. The key clamp 310 fits in and around the tubular body 120 of the saxophone in one end, and fits and maintains a pressure to hold down the D# key 104 at the other end. As a result of the deployment of the key clamp 310, the D# pad cup 102 is in an open configuration (e.g., the configuration as shown in FIG. 2B). Therefore, more airs are allowed to flow through the opening and the D# pad is dried out quicker.

A perspective view, a top plan view, and two side elevation views of the exemplary key clamp 310 of FIG. 3 are shown in FIGS. 4A-4D, respectively. The key clamp 310 is made of a continuous slightly flexible wire, having a first end 422 and a second end 432, that includes two parts: a first segment 402 and a second segment 404. The first segment 402 and the second segment 404 are oriented substantially perpendicular to each other but non-coplanar at a common point 428 between the first end 422 and the second end 432. For example, a plane 412 containing the first segment 402 and a plane 414 containing the second segment 404 are not co-planar but are substantially perpendicular to each other. The first segment 402 has a form of an unsymmetrical S-shape that has a larger opening near the first end 422 and a smaller opening near the second segment 404. The larger opening of the S-shape is configured to adjustably form an arc so that the arc can be fitted in and around the tubular body 120 of a saxophone. The function of the arc is to stabilize the key clamp 310 so that the second segment 404 can be fitted into a space between the top the D# key and the lip of a tone hole located nearby (e.g., the E tone hole). The second segment 404 has a form of a substantially closed loop, which is formed by bending the second end 432 back towards the second segment 404 of the wire. The shape of the closed loop may include, but not necessarily be, triangular, quadrilateral, polygonal, and round (e.g., circular, oval, etc.). The function of the closed loop is to reinforce the second segment 404 such that a pressure larger than the resistance of the spring of the D# key 104 can be maintained when the key clamp 310 is deployed onto a saxophone.

In one embodiment, the key clamp 310 is made of a continuous wire covered with sturdy soft coating (e.g., plastic or alike). The continuous wire is made of a material soft enough that can be reshaped by a player's hands, but strong enough that can maintain a pressure to hold down the D# key 104 hence to keep the D# pad cup 102 open. The main function of the coating is to prevent scratches to the saxophone when the key clamp 310 is deployed. In other word, not only the material of the coatings needs to be softer than that of the saxophone, but also needs to be sturdy enough to endure the wear and tear of repetitive usages so that the wire inside will not be exposed.

The present invention can be implemented in many ways, each of which may yield one or more of the following benefits, advantages or features. One of them is to keep the pad of the D# tone hole and pad cup as dry as possible while a saxophone is not being played, thereby the notes produced from the D# tone hole are proper. Other benefits, advantages or features can be appreciated by those skilled in the art given the detailed description herein.

Although exemplary embodiments of present invention have been disclosed, it will be apparent to those skilled in the art that various changes and modifications may be made to achieve the advantage of the invention. It will be obvious to those skilled in the art that some components may be substituted with another component providing same function. The appended claims cover the present invention.

What is claimed is:

1. A saxophone attachment for keeping D# (D sharp) pad cup of a saxophone open when the saxophone is not being played, said saxophone attachment comprising:

a continuous slightly flexible wire having a first end and a second end, said wire having a first segment starting at said first end, and a second segment ending at said second end, said first segment and said second segment are orientated substantially perpendicular to each other but non-coplanar, wherein said first segment has a form of an unsymmetrical S-shape, and said second segment has a form of a substantially closed loop and wherein said first end and said second end are located in opposite end of the wire configured to astraddle tubular body of the saxophone with the second end near D# key and the first end on outer surface of the tubular body in opposite to the D# key.

2. The saxophone attachment of claim 1, wherein said wire is made of soft metal.

3. The saxophone attachment of claim 2, wherein said soft metal is substantially soft enough to be adjustable by human hands.

4. The saxophone attachment of claim 2, wherein the soft metal is substantially strong enough for maintaining a pressure keeping the D# key pressed down.

5. The saxophone attachment of claim 1, wherein said first segment and said second segment are coated with a soft material as a protective shield to prevent scratches to surface of the saxophone.

6. The saxophone attachment of claim 1, wherein said unsymmetrical S-shape has a larger opening near said first end and a smaller opening near said second segment.

7. The saxophone attachment of claim 6, wherein said larger opening is configured to adjustably fit around the outside of tubular body of the saxophone.

8. The saxophone attachment of claim 6, wherein said smaller opening is configured to be adjustably fit between the D# key and the tubular body of the saxophone.

9. The saxophone attachment of claim 1, wherein said substantially closed loop is formed by bending said second end back towards said second segment of said wire.

10. The saxophone attachment of claim 9, wherein said substantially closed loop has a shape of triangular, quadrilateral, polygonal or round.

11. The saxophone attachment of claim 10, wherein said substantially closed loop is configured to be placed on top of the D# key maintaining a pressure to keep the D# key pressed down thereby the D# pad cup open.

12. The saxophone attachment of claim 11, wherein said pressure is larger than resistance force of a spring of the D# key.

13. The saxophone attachment of claim 1, wherein said first segment and said second segment shares a common point between the first end and the second end, wherein the common point is located substantially closer to said second end than said first end.

14. The saxophone attachment of claim 1, wherein the saxophone includes Alto, Soprano, Baritone or Tenor.

* * * * *